US010406546B2

(12) United States Patent
Rossignol

(10) Patent No.: US 10,406,546 B2
(45) Date of Patent: Sep. 10, 2019

(54) SUCTION DEVICE FOR A LIQUID PRODUCT IN A DISPENSER

(71) Applicant: ALBEA LACROST, Lacrost (FR)

(72) Inventor: Eric Rossignol, Chalon sur Saone (FR)

(73) Assignee: ALBEA LACROST, Lacrost (FR)

( * ) Notice: Subject to any disclaimer, the term of this patent is extended or adjusted under 35 U.S.C. 154(b) by 22 days.

(21) Appl. No.: 15/417,422

(22) Filed: Jan. 27, 2017

(65) Prior Publication Data

US 2017/0216865 A1 Aug. 3, 2017

(30) Foreign Application Priority Data

Feb. 1, 2016 (FR) ..... 16 50783

(51) Int. Cl.
*B05B 11/00* (2006.01)
*B05B 15/30* (2018.01)

(52) U.S. Cl.
CPC ..... *B05B 11/3045* (2013.01); *B05B 11/0041* (2018.08); *B05B 11/0097* (2013.01); *B05B 11/3047* (2013.01); *B05B 15/30* (2018.02); *B05B 11/0081* (2013.01)

(58) Field of Classification Search
CPC . B05B 11/3045; B05B 11/30; B05B 11/0097; B05B 11/3047; B05B 11/0081; B65D 83/0033; B65D 83/0005
USPC ..... 222/383.1
See application file for complete search history.

(56) References Cited

U.S. PATENT DOCUMENTS

| | | | | |
|---|---|---|---|---|
| 2,950,031 | A | 8/1960 | Abplanalp et al. | |
| 4,793,522 | A * | 12/1988 | Corsette | B65D 83/0033 222/257 |
| 5,548,943 | A * | 8/1996 | Behar | B05B 11/0013 53/473 |
| 5,788,124 | A * | 8/1998 | Bougamont | B65D 83/0033 222/207 |
| 7,578,319 | B2 * | 8/2009 | Behar | B05B 11/0013 141/2 |
| 2007/0119868 | A1 * | 5/2007 | Kraemer | B65D 83/0005 222/256 |
| 2010/0221132 | A1 | 9/2010 | Cohen et al. | |
| 2010/0252136 | A1 | 10/2010 | Koch | |

FOREIGN PATENT DOCUMENTS

FR 2926798 A1 7/2009

OTHER PUBLICATIONS

Sep. 20, 2016—(FR) Search Report—App 1650783.

* cited by examiner

*Primary Examiner* — Jeremy Carroll
(74) *Attorney, Agent, or Firm* — Banner & Witcoff, Ltd.

(57) ABSTRACT

Suction device for a liquid product present in a dispenser has a container 6 provided with means for sampling the product 7. The device is developed about a central axis X and has a centralised product suction channel 8 coaxial to the central axis X and having an inlet 14 and an outlet; and annular suction means connected to the inlet 14 of the centralised suction channel 8.

11 Claims, 2 Drawing Sheets

SUCTION DEVICE FOR A LIQUID PRODUCT IN A DISPENSER

CROSS-REFERENCE TO RELATED APPLICATIONS

This application claims priority to French Application Serial No. 1650783 filed Feb. 1, 2016 which application is hereby incorporated by reference in its entirety.

FIELD OF THE INVENTION

The invention relates to a suction device for a liquid product in a dispenser comprising a container provided with means for sampling the product. The invention further relates to a liquid product dispenser comprising such a suction device. Finally, the invention relates to a method for manufacturing such a suction device.

More specifically, the invention is applicable to the dispensing of cosmetic or pharmaceutical products from a container particularly provided with means for sampling the product.

It can be a rigid or flexible container. It also can be an airless or non-airless container.

In the case of an airless container, as the consumer samples the product, either a negative pressure develops in the container and the sampling system must overcome this negative pressure in order to continue to operate correctly or the internal volume of the container decreases, either by deforming, if the container is flexible, or, if the container is rigid, by virtue of a movable base provided with sealing means, via a piston, for example, in order to compensate for the vacuum thus created.

BACKGROUND

The means for sampling the product generally consist in a pump associated with a pushbutton. The pump comprises a central opening. The product enters the opening of the pump, either directly if the container is airless or via a plunger tube extending the pump if the container is non-airless. In both cases, the product enters the pump in a central manner This involves suction, called centralised suction.

This type of central suction has a high suction speed since the product enters the pump directly without pressure loss.

However, there are numerous products that exhibit fragile stability and that can phase change or allow, in the case of a transparent container, a suction stream to occur that is inherent to this type of central suction of the pump at high speed.

SUMMARY OF THE INVENTION

The object of the present invention is to overcome the various aforementioned disadvantages by means of a suction device that has a lower suction speed and is adapted to any type of container.

This object is achieved by virtue of a suction device for a liquid product present in a dispenser comprising a container provided with means for sampling the product, said device being developed about a central axis and comprising:

- a centralised product suction channel coaxial to the central axis and having an inlet and an outlet;
- annular suction means connected to the inlet of the centralised suction channel.

The main idea of this invention consists in aspirating the product firstly in an annular manner and then in a centralised manner The product thus follows a different path to that of the prior art. It is no longer directly aspirated in a centralised manner into the pump or into the tube connected to the pump, but it is diverted in annular suction means that create a pressure loss before being aspirated into the pump. This pressure loss allows the suction speed of the product inside the dispenser to be significantly reduced and thus permits avoidance of the phenomenon of phase changing the product, which alters its chemical properties, and/or the phenomenon of an unsightly suction.

Advantageously, said annular suction means comprise an annular suction inlet having a section that is larger than the section of the inlet of the centralised suction channel. Thus, the product will firstly pass through a first relatively large and annularly located inlet section, which forces it to take a corner in its path and thus slow it down, whilst reducing the pressure of the product by virtue of the large section, then through a second smaller and centrally located inlet section, which forces it to take an additional corner in its path with an additional reduction in the section, which progressively reduces its suction speed even further.

Suction is thus carried out in a specific manner inside the container and at a speed that is calibrated so that the flow of product output from the dispenser is sufficient to satisfy the consumer, whilst avoiding any excess speed so that the product remains stable within the container.

According to the various embodiments of the invention, which can be taken in combination or individually:

- the annular suction inlet is oriented substantially perpendicular to the central axis;
- said annular suction means comprise a body for diverting the product that defines an annular passage opening out on the inlet of the centralised suction channel;
- the diversion body consists in a body of revolution about the central axis;
- said body comprises:
- an upper part provided with a central opening corresponding to the inlet of the centralised suction channel, a socket delimiting the centralised suction channel extending from this upper part;
- a lower part without an opening following the profile of the upper part; the annular passage being defined between the upper part and the lower part;
- the annular suction inlet is located at the peripheral edge of the lower part;
- the suction end of a pump equipping a dispensing head is directly inserted into said socket;
- the suction end of a pump equipping a dispensing head extends by a suction tube pushed to the bottom of the container and the suction end of the tube is inserted into said socket: this example is adapted both to a non-airless dispenser and to an airless dispenser;
- the lower part is connected to the upper part whilst leaving opening zones in order for the product to be able to circulate from the annular passage to the centralised suction channel;
- the lower part and the upper part of the body consist in two distinct parts;
- the lower part and the upper part of the body consist in a single part obtained by moulding;
- said body is made from a flexible material;
- the lower part is in the shape of a dome;
- the lower part of the body is deformable between a first stable concave shape obtained after moulding and a second stable convex shape obtained by turning over and corresponding to its operational shape for annular suction;

the upper part consists in a bleed ring comprising a deformable lip seal, the deformation of the lip when mounting the ring in the dispenser causing the air to be purged from the dispenser: this example is adapted to an airless dispenser.

The invention further relates to a liquid product dispenser comprising a container provided with a suction device for the product as described above.

Finally, the invention relates to a method for manufacturing a suction device as described above, comprising the following steps:

moulding the upper part and the lower part in a single mould, the lower part being in the shape of a concave dome, with a curvature that is opposite to the curvature of the upper part;

turning over the lower part so that it is in the shape of a convex dome, with a curvature following the curvature of the upper part.

This method is highly advantageous as it allows the entire suction device to be moulded at one time, and thus allows a single part to be obtained, which saves considerable time when manufacturing the device. It also allows device manufacture to be simplified compared to a two-part assembly (lower part and upper part), which then must be provided with fixing means that are expensive and complicated to implement.

When the upper part consists in a bleed ring, said ring generally equips an airless liquid product dispenser.

This bleed ring comprises a deformable lip seal accommodated inside a protective part designed to be inserted inside the container, the deformation of the lip when mounting the ring in the container causing the air to be purged from the container.

The idea consists in systematically associating a protective part intended to protect the fragile lip of the bleed ring, from its time of manufacture until it is mounted in the dispenser.

The purpose of the bleed ring is to purge the residual air present in the container when assembling the dispenser. The bleed ring is only activated when assembling the dispenser so that it can be placed into service devoid of return air. The bleed ring is no longer used once the dispenser is placed into service and delivers doses of product. The absence of air in the container is then guaranteed either by the deformation of the container or by a movable piston.

According to the various embodiments of the invention, which can be taken in combination or individually:

the bleed ring is provided with retention and wedging means cooperating with the protective part;

the retention and wedging means consist in a socket inserted and wedged into a central sleeve extending from the protective part;

the axial socket of the bleed ring is inserted into the central sleeve of the protective part;

the bleed ring is formed by a cap that is annularly extended by said lip seal;

said lip seal connects to the edge of the cap via a concave portion and presses against an internal wall of the protective part by buttressing;

said protective part is made up of a disc provided with a central opening, from which a central sleeve extends, and a peripheral skirt seal connected to the external edge of the disc, the peripheral lip seal of the bleed ring coming to bear against the internal wall of said peripheral skirt seal of the protective part;

the disc of the protective part has a circular section;

the disc of the protective part has an oval section;

the protective part consists in a neck belonging to a dispensing head of the product dispenser;

the neck is clipped onto a pump equipping the dispensing head;

the lip of the bleed ring is elastically deformed by overpressure when assembling the dispensing head on the container.

DESCRIPTION OF THE DRAWINGS

The invention will be better understood, and further objects, details, features and advantages thereof will become more clearly apparent, throughout the following detailed description of at least one embodiment of the invention, which is provided by way of a purely illustrative and non-limiting example, with reference to the accompanying schematic drawings, in which.

DETAILED DESCRIPTION

The suction device shown in the various Figs. is intended to be mounted on dispensers of liquid or semi-liquid products 7.

The embodiment described hereafter is limited to a dispenser operating airlessly and which is sometimes called "airless" dispenser.

However, as previously explained, the suction device according to the invention equally can be mounted on a dispenser operating non-airlessly.

Figure 1:
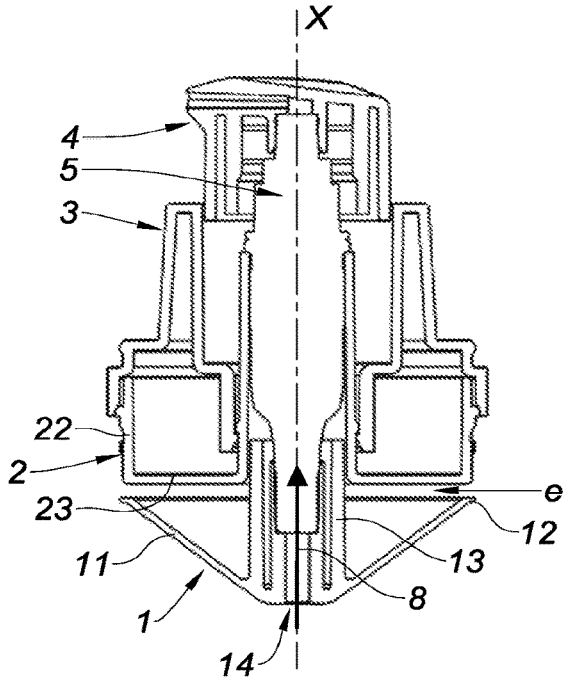
Fig. 1 Prior Art
FIG. 1 shows a section view of a dispensing head provided with a suction device according to the prior art.

FIG. 1 shows a dispensing head according to the prior art conventionally comprising the following elements:

a pushbutton 4;

a pump 5 bringing the product from a container (not shown) to the pushbutton 4;

a neck 2 mounted on the pump 5;

a finishing collar 3 mounted on the neck 2 and allowing the pump 5 to be concealed.

In this case, the container can consist in a flexible container of the bag type or a rigid container of the bottle type. This container may or may not contain a piston or any other system allowing the dispenser to operate airlessly.

Such a dispensing head can include residual air as it is assembled onto the container during the packaging operation. This residual air can hinder the use of the product to be dispensed.

To this end, a flexible bleed ring 1 is added to the dispensing head and allows the air purge function to be provided prior to the normal use of the dispenser.

This bleed ring 1 is fixed to the neck 2 of the dispensing head.

More specifically, it consists in a cap 11 with a truncated aspect, extended laterally outwards by a lip seal 12, directed perpendicular to the central axis X of the ring 1 that corresponds to the central axis of the dispensing head. This lip 12 is generally made from a flexible material, for example a low-density polyethylene, or is also elastomer-based, and is fragile, particularly at its thin end, which is intended to come into abutment, under a slight stress, against the internal wall of the container.

The bleed ring 1 further comprises an axial socket 13 centred on the cap 11 and defining a centralised suction channel 8 opening out on an opening 14 made in the cap 11. This opening 14 consists in the inlet of the centralised suction channel 8.

This socket 13 is provided with clipping means so that it can be fixed to the pump 5.

The ring 1 is thus fixed to the pump 5 and projects from the lower part of the dispensing head. The lip 12 is separated from the neck 2 by a gap e. The lip 12 is thus exposed, without any protection surrounding it, and can be damaged during the bulk storage of the dispensing heads thus equipped with rings 1.

When mounting this dispensing head on a container, the ring purges the container by overpressure. This will be described in further detail in the following Figs.

When the purge is complete, the dispenser is ready to use. The user can then sample a dose of the product contained in the container by pressing the pushbutton 4 of the dispensing head.

The product contained in the container is then aspirated and passes through the inlet 14 of the centralised suction channel 8, then through the centralised suction channel 8 of the socket 13, then into the pump 5 in order to be brought to the pushbutton 4 and discharged from the dispenser.

The product present in the container thus enters the centralised suction channel 8 directly along the axis X. The suction speed is relatively high as there is no obstacle in the path of the product, with the exception of the inlet section of the centralised distribution channel, which limits the amount of product sampled when the pushbutton 4 is pressed. With respect to products with a certain amount of fragility in terms of their stability, this suction, which suddenly shifts the product 7 from the static state to a high-speed moving state, can cause the product to phase change and/or the occurrence of a relatively unsightly suction stream, especially when the container is transparent.

Figure 2:
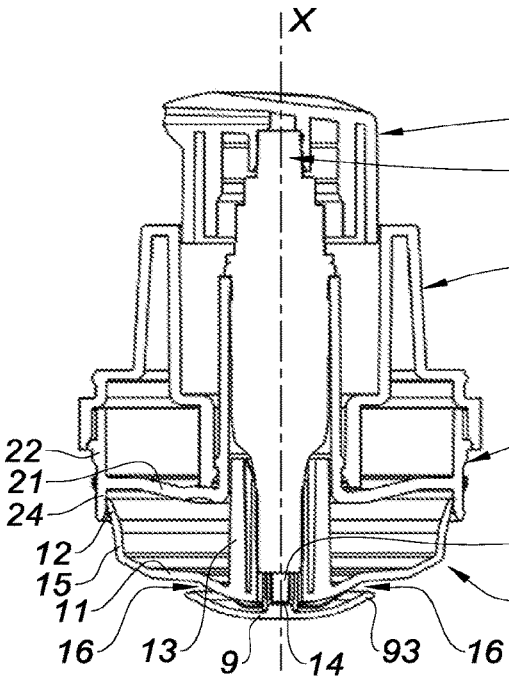
FIG. 2 shows a section view of a dispensing head provided with a suction device according to one possible configuration of the invention.

FIG. 2 shows a dispensing head according to the invention. It is similar to that of FIG. 1 with respect to the elements that use the same reference numeral, with the exception of the neck 2 and the bleed ring 1.

Indeed, the neck 2 is now provided with a peripheral skirt 24 extending towards the ring 1 in order to protect its lip 12.

More specifically, the neck 2 conventionally comprises a disc 21, of circular or oval section, for example, provided with a central opening, from which a central sleeve 23 extends, into which the lower part of the pump 5 is inserted. This neck 2 further conventionally comprises an annular return 22 directed towards the pushbutton 4 and allowing the centring and wedging of the finishing collar 3. In addition to this return, and as previously mentioned, the neck 2 comprises, according to the invention, a peripheral skirt 24 connected to the edge of the disc 21 and extending in a direction opposite the annular return 22. The lip 12 of the ring 1 comes into abutment against the internal wall of this peripheral skirt 24, as is the case in the embodiment described with reference to FIG. 1.

The airtightness between the dispensing head and the container is not provided by the ring 1 but is provided by the peripheral skirt 24 of the neck 2. This skirt 24 thus comes into sealed abutment against the internal wall of the container.

The ring 1, however, still comprises a cap 11 with a truncated aspect, but with a clearly more obtuse angle, allowing a significant reduction in the height of the ring 1. Thus, the spatial requirement of the ring 1 is reduced compared to the prior art, which allows more compact dispensers to be manufactured for an equivalent volume of product. The cap also can be hemispherical.

The lip seal 12 is directed parallel to the central axis X of the ring 1. This lip 12 connects to the edge of the cap 11 via a concave portion 15. The lip 12 comes into contact with the internal wall of the peripheral skirt 24 of the neck 2 by buttressing. The lip 12 of the bleed ring 1 is thus accommodated in the skirt 24 of the neck 2. This lip 12 is thus protected in the event of bulk packaging of the dispensing heads and their seal can be checked before assembly on the container 6. The neck 2 thus acts as a protective part for the ring 1.

Figure 3:
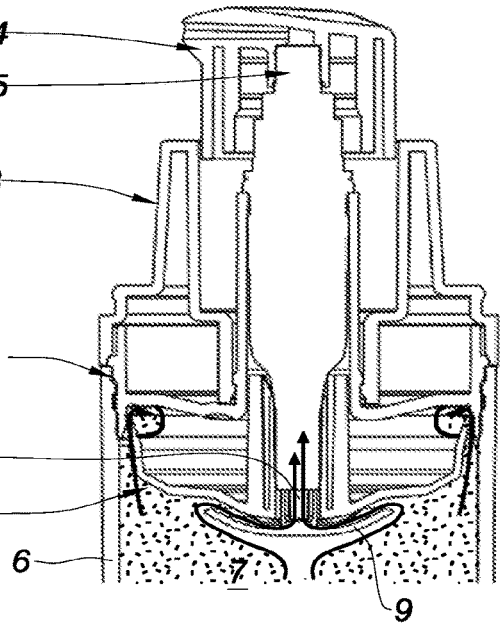
FIG. 3 shows the dispensing head according to FIG. 2 assembled on a container.

The operation of this ring is shown in FIG. 3. When the head is pushed onto the container 6 during packaging (i.e. when assembling the dispenser), the skirt seal 24 of the neck 2 accommodates into the container 6. Lowering this head into the product 7 causes a slight overpressure in the container 6, which elastically deforms the lip 12 of the bleed ring 1 so that the residual air present in the container 6 can pass between the skirt 24 of the neck 2 and the lip 12 of the ring 1 in order to escape from the container 6. This air is then contained in a space provided to this end between the ring 1 and the neck 2. A slight overflow of the liquid product 7 in this same space, after having expelled the air over the top of the flexible lip 12, allows the assembly to be fully purged, as shown by the two lateral arrows.

This container 6 can be flexible or rigid and may or may not contain a piston (or another system) for following the variability of the volume of product 7.

An additional part 9 is shown in FIGS. 2 and 3. It is disposed under the ring 1 and is connected to the ring 1.

This part 9 is a rotational part centred on the axis X and extending orthogonal to the axis X. It preferably follows the profile of the cap 11 located immediately above.

In the example shown, the cap 11 has a generally flat shape, with a slight bulge in its central zone, from which the socket 13 protrudes. This bulge gives the cap 11 a slightly rounded shape in this central part. The part 9 follows this rounded profile and more specifically consists in a dome.

The part 9 does not have any openings.

This part 9 forms an obstacle in front of the inlet 14 of the centralised suction channel 8. When dispensing, the product can no longer enter the channel 8 directly. It must take another path, as follows:

- bypass the lower surface of the part 9: this part creates a pressure loss within the dispenser;
- enter an annular passage 16 defined between the upper surface of the part 9 and the lower surface of the cap 11 of the ring 1: the direction of circulation of the product is then orthogonal to the axis X;
- enter the centralised suction channel 8: the direction of circulation of the product is then parallel to the axis X.

This path is shown by the central arrows in FIG. 3.

The product thus must bypass the part 9, take a first tight corner in order to be able to enter the annular passage 16, then take a second tight corner in order to be able to enter the centralised suction channel 8. This path significantly decreases the suction speed of the product. It is no longer a centralised suction, but is an annular suction.

The inlet section of the annular passage 16 is larger than the inlet section 14 of the centralised suction channel 8. This progressive reduction in the suction section, along the path of the product, allows less abrupt, more fluid suction to be obtained so that the product does not surge and its stability is maintained.

Finally, the suction device according to the invention consists in a body made up of an upper part consisting in the ring 1 and a lower part consisting in the part 9. The inlet of the annular passage 16 is located at the peripheral edge 93 of the part 9.

The ring 1 and the part 9 can consist in two distinct parts connected via conventional assembly means.

Figure 4:
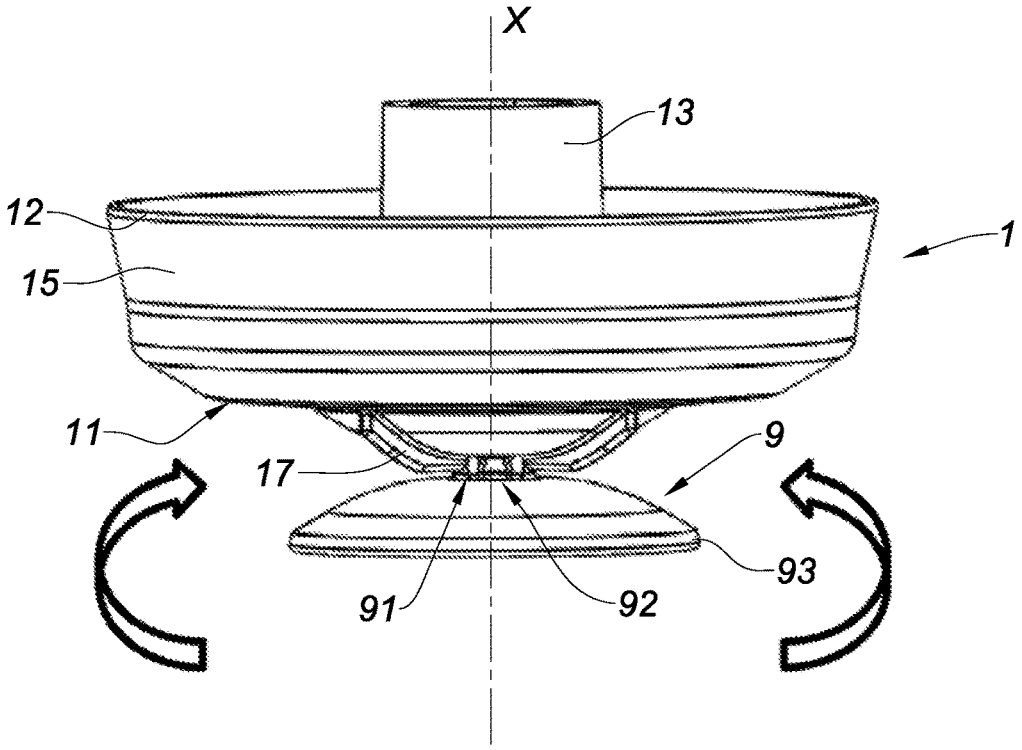
FIG. 4 shows a perspective view of the suction device according to FIGS. 2 and 3 after the moulding phase.
Figure 5:
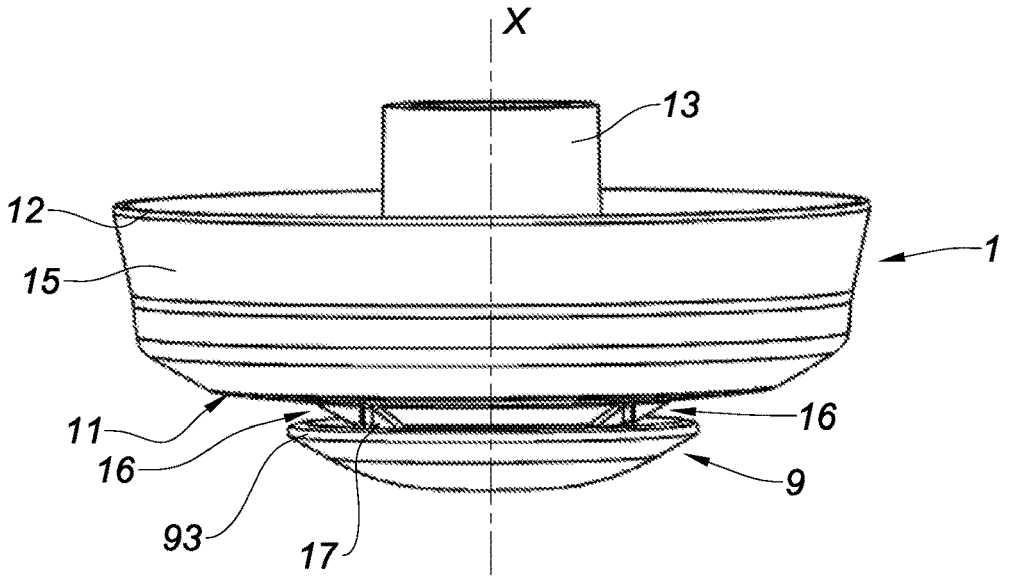
FIG. 5 shows a perspective view of the suction device according to FIGS. 2 and 3 after the turning over phase.

Advantageously, they can consist in a single part obtained by moulding, as shown in FIGS. 4 and 5. In this case, the ring 1 and the part 9 are moulded in a single mould. However, such moulding raises a demoulding problem at the annular passage 16 as the part 9 in the shape of a dome prevents access to the inside of the annular passage 16 in order to be able to correctly demould this zone.

In order for the moulding to be feasible, the part 9 in the shape of a dome is moulded with a concave curvature in order to completely clear the zone of the annular passage, as shown in FIG. 4. This concave curvature consists in a curvature that is opposite to that of the central part of the cap 11 of the ring 1.

The part 9 and the central part of the cap 11 of the ring 1 are connected via linking lugs 91 that leave opening zones 92 between them in order for the product to pass to the centralised suction channel 8.

After demoulding the ring 1 and the part 9, said part is turned over in order to assume a stable position as a dome, this time with a convex curvature, following the curvature profile of the central part of the ring 1. This is shown in FIG. 5.

The material used for the ring 1 and the part 9 consists in a flexible material of the elastomer type with elastic properties, in order to allow the part 9 to turn over in this way.

The body making up the suction device is thus manufactured in only two steps, i.e. a step of moulding its upper 1 and lower 9 parts and a step of turning over its lower part 9.

In order to maintain a constant annular passage 16 all around the axis X, ribs 17 are provided on the lower surface of the cap 11 of the ring 1, which ribs are evenly distributed. These ribs 17 are moulded with the ring 1. The upper surface of the part 9 thus can come into contact with these ribs 17, which allows a constant space to be left between the upper surface of the part 9 and the lower surface of the cap 11 of the ring 1.

With respect to the aforementioned description, the optimal dimensional relations for the parts of the invention, including the size, materials, shape, function and operating, assembly and user mode variations, are considered to be apparent and clear to persons skilled in the art, and any relations equivalent to those shown in the drawings and contained in the description are considered to be included in the present invention.

The invention claimed is:

1. Dispenser for a liquid product comprising a container equipped with a pump for sampling the liquid product and a suction device for said liquid product, said suction device being developed about a central axis X and comprising:

a centralized product suction channel coaxial to the central axis X and having an inlet and an outlet, said outlet opening out on said pump for sampling the liquid product;

annular suction means connected to the inlet of the centralized product suction channel, said annular suction means comprising a body for diverting the liquid product that defines an annular passage directly opening out on the inlet of the centralized product suction channel;

wherein said body comprises an upper part accommodating the pump, and a lower part, the annular passage being defined between the upper part and the lower part, and wherein the liquid product does not contact an external wall of the pump.

2. Dispenser according to claim 1, wherein said annular suction means comprise an annular suction inlet having a section that is larger than the section of the inlet of the centralized product suction channel.

3. Dispenser according to the claim 2, wherein the annular suction inlet is oriented substantially perpendicular to the central axis X.

4. Dispenser according to claim 1, wherein:

the upper part is provided with a central opening corresponding to the inlet of the centralized product suction channel, a socket delimiting the centralized product suction channel extending from this upper part;

the lower part without an opening follows the profile of the upper part.

5. Dispenser according to claim 4, wherein the lower part is connected to the upper part whilst leaving opening zones in order for the liquid product to be able to circulate from the annular passage to the centralized product suction channel.

6. Dispenser according to claim 4, wherein the lower part and the upper part of the body are two distinct parts.

7. Dispenser according to claim 4, wherein the lower part and the upper part of the body are a single part.

8. Dispenser according to claim 1, wherein said body is made from a flexible material.

9. Dispenser according to claim 4, wherein the lower part is in the shape of a dome.

10. Dispenser to claim 9, wherein the lower part of the body is deformable between a first stable concave shape and a second stable convex shape.

11. Dispenser according to claim 4, wherein the upper part consists of a bleed ring comprising a deformable lip seal, the deformation of the lip seal when mounting the bleed ring in the dispenser causing air to be purged from the dispenser.

* * * * *